US010672538B2

(12) United States Patent
Kobayashi et al.

(10) Patent No.: US 10,672,538 B2
(45) Date of Patent: Jun. 2, 2020

(54) COMPOSITE CABLE

(71) Applicants: SUMITOMO WIRING SYSTEMS, LTD., Yokkaichi-shi, Mie (JP); SUMITOMO ELECTRIC INDUSTRIES, LTD., Osaka-shi, Osaka (JP)

(72) Inventors: Kenta Kobayashi, Mie (JP); Akira Kitabata, Mie (JP); Takaya Kohori, Tochigi (JP); Masayuki Ishikawa, Tochigi (JP)

(73) Assignees: SUMITOMO WIRING SYSTEMS, LTD., Mei (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/603,530

(22) PCT Filed: Feb. 7, 2018

(86) PCT No.: PCT/JP2018/004238
§ 371 (c)(1),
(2) Date: Oct. 7, 2019

(87) PCT Pub. No.: WO2018/198476
PCT Pub. Date: Nov. 1, 2018

(65) Prior Publication Data

US 2020/0066425 A1 Feb. 27, 2020

(30) Foreign Application Priority Data

Apr. 28, 2017 (JP) ..... 2017-090041

(51) Int. Cl.
*H01B 9/00* (2006.01)
*H01B 9/02* (2006.01)

(52) U.S. Cl.
CPC ..... *H01B 9/003* (2013.01); *H01B 9/02* (2013.01)

(58) Field of Classification Search
CPC . H01B 9/003; H01B 9/02; H01B 7/00; H01B 7/18; H01B 7/38; H01B 11/06
(Continued)

(56) References Cited

U.S. PATENT DOCUMENTS 2,981,788 A * 4/1961 Bunish ..... H01B 9/028 174/115
3,614,300 A * 10/1971 Wilson ..... H01B 7/182 174/115

(Continued)

FOREIGN PATENT DOCUMENTS

JP H01313807 A 12/1989
JP 2005-166402 A 6/2005

(Continued)

OTHER PUBLICATIONS

U.S. Appl. No. 16/603,541, filed Oct. 7, 2019 in the name of Kobayashi et al.

(Continued)

*Primary Examiner* — Sherman Ng
(74) *Attorney, Agent, or Firm* — Oliff PLC

(57) ABSTRACT

A composite cable in which noise generated by a ground wire is less likely to intrude signal lines even in the case where the ground wire is combined. The composite cable includes a plurality of wires, a separator which covers the outer circumference of the plurality of wires all together, and a sheath which covers the outer circumference of the separator. The plurality of wires includes a plurality of signal lines, a plurality of power lines, and a ground wire. The ground wire is isolated from the plurality of signal lines with the plurality of power lines interposed therebetween.

4 Claims, 3 Drawing Sheets

(58) Field of Classification Search
USPC ..... 174/102 R, 107
See application file for complete search history.

(56) References Cited

U.S. PATENT DOCUMENTS

| | | | | |
|---|---|---|---|---|
| 4,374,299 | A * | 2/1983 | Kincaid | H01B 11/1091 174/105 SC |
| 4,398,058 | A * | 8/1983 | Gerth | H01B 7/202 174/106 D |
| 7,166,802 | B2 * | 1/2007 | Cusson | H01B 7/20 174/105 R |
| 7,297,873 | B2 * | 11/2007 | Grogl | H01B 7/292 174/121 A |
| 9,959,954 | B1 * | 5/2018 | Jackson | H02G 3/0468 |
| 2006/0021786 | A1 * | 2/2006 | Fetterolf, Sr. | H01B 9/003 174/113 R |
| 2008/0190643 | A1 | 8/2008 | Lumachi et al. | |
| 2010/0000759 | A1 | 1/2010 | Lumachi et al. | |
| 2011/0200289 | A1 | 8/2011 | Sorimachi et al. | |
| 2011/0278043 | A1 * | 11/2011 | Ueda | H01B 7/1895 174/115 |
| 2014/0262423 | A1 * | 9/2014 | Westrick, Jr. | H02G 3/0481 174/103 |
| 2014/0326480 | A1 | 11/2014 | Hashimoto et al. | |
| 2018/0025808 | A1 | 1/2018 | Hashimoto et al. | |
| 2018/0281706 | A1 | 10/2018 | Kobayashi | |
| 2019/0115123 | A1 | 4/2019 | Hashimoto et al. | |

FOREIGN PATENT DOCUMENTS

| | | | |
|---|---|---|---|
| JP | 2005-166450 | A | 6/2005 |
| JP | 2007535111 | A | 11/2007 |
| JP | 2011-165575 | A | 8/2011 |
| JP | 2014-220043 | A | 11/2014 |
| JP | 2015138751 | A | 7/2015 |
| JP | 2017-003762 | A | 1/2017 |
| JP | 201776515 | A | 4/2017 |
| JP | 2017097965 | A | 6/2017 |

OTHER PUBLICATIONS

Aug. 7, 2018 International Preliminary Report on Patentability issued in International Patent Application No. PCT/JP2018/004237.
Mar. 6, 2018 International Search Report issued in International Patent Application No. PCT/JP2018/004237.

* cited by examiner

COMPOSITE CABLE

TECHNICAL FIELD

The present invention relates to a composite cable.

BACKGROUND ART

Conventionally in the field of vehicles such as automobiles, a composite cable with a multi-core structure as described in Patent Document 1, etc., has been known, in which the outer circumference of a plurality of wires are covered with a sheath all together. Specifically, in the document, the plurality of wires is composed of a plurality of signal lines, a plurality of power lines, and a single disconnection detection line.

PRIOR ART LITERATURE

Patent Document

Patent Document 1 JP-A-2005-166450

SUMMARY OF THE INVENTION

Problem to be Solved by the Invention

Meantime, in the composite cable with a multi-core structure, it is conceivable to combine a ground wire in addition to the plurality of signal lines and the plurality of power lines in order to enable earthing at both ends of one cable. However, the ground wire fundamentally has a property to easily generate electric noise. Therefore, there is a problem such as the signal lines easily are affected by electric noise if no measure is taken.

The present invention has been made in view of such a background, and it is intended to provide a composite cable in which noise generated by the ground wire is less likely to intrude the signal lines even in the case where a ground wire is combined.

Means for Solving the Problem

One aspect of the present invention is a composite cable including:

a plurality of wires;

a separator that covers the outer circumference of the plurality of wires all together; and a sheath that covers the outer circumference of the separator, wherein the plurality of wires includes a plurality of signal lines, a plurality of power lines, and a ground wire, and the ground wire is isolated from the plurality of signal lines with the plurality of power lines interposed therebetween.

Effects of the Invention

The above-mentioned composite cable has the above-mentioned configuration. In the composite cable, the ground wire is isolated from the plurality of signal lines with the plurality of power lines interposed therebetween. According to such a configuration of the composite cable, a physical distance between the ground wire and the signal lines can be ensured by interposing the plurality of power lines therebetween, so that electric noise generated from the ground wire becomes less likely to intrude the signal lines.

MODES FOR CARRYING OUT THE INVENTION

Figure 1:
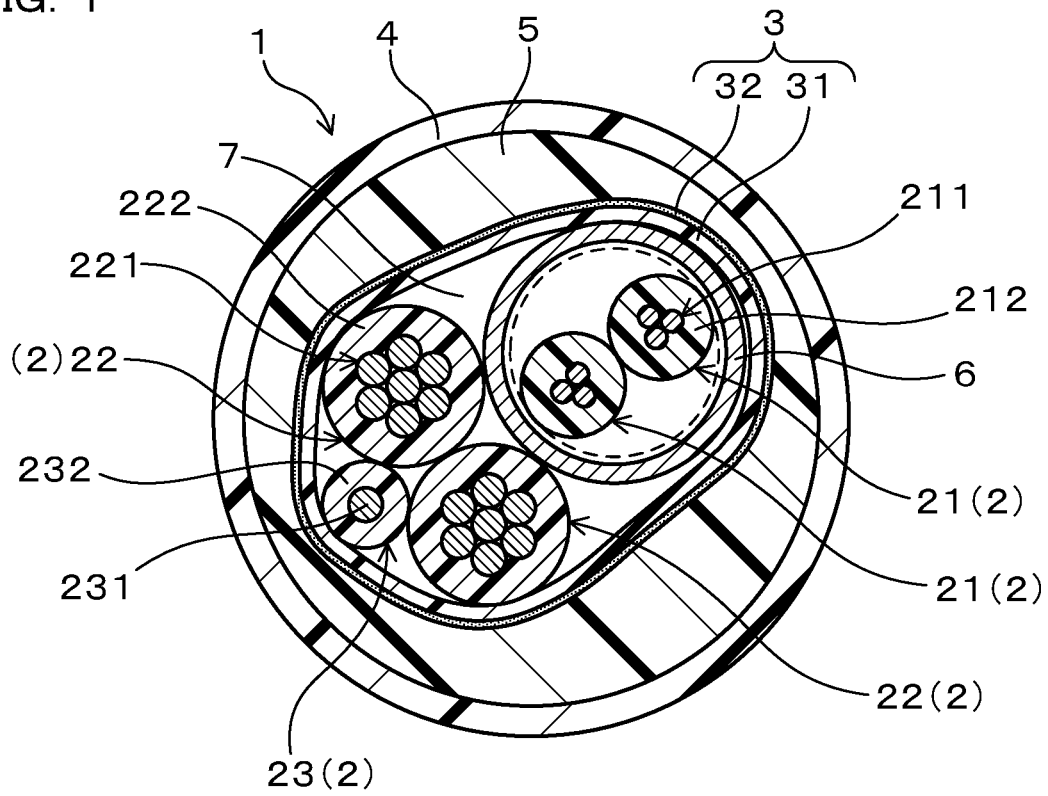
FIG. 1 is an illustration schematically showing a composite cable according to Embodiment 1 in a cross section perpendicular to the center axis of the cable.

In the composite cable, the plurality of wires includes the plurality of signal lines, the plurality of power lines, and the ground wire. Here, the signal lines are wires for use in transmitting an electrical signal. The power lines are wires for use in supplying power, such as a power supply line.

The plurality of signal lines can be configured to include at least one twisted pair line composed of two signal lines twisted together, the outer circumference of the twisted pair line being covered by a shield conductor. In the composite cable, the signal lines are arranged near the power lines which generate electric noise. According to the above-mentioned configuration, the two signal lines are less likely to be affected by electric noise because they are twisted together. Further, according to the above-mentioned configuration, the twisted pair line is less likely to be affected by electric noise also because the twisted pair line is covered by the shield conductor. For these reasons, according to the above-mentioned configuration, not only noise reduction effects brought about by the above-mentioned arrangement of the power lines, the ground wire, and the signal lines but also noise reduction effects brought about by the shield conductor can be achieved, so that a composite cable that is further excellent in noise countermeasure can be obtained. In addition, according to the above-mentioned configuration, even in the case where the shield conductor can be grounded at one end side of the composite cable but can be hardly grounded at the other end side of the composite cable, the composite cable can be used in such a manner that the shield conductor is connected to the ground wire at the other end side of the composite cable, and the ground wire is grounded at the one end side of the composite cable. Therefore, according to the above-mentioned configuration, a composite cable suitable for use under vehicle conditions in which grounding of the composite cable at one end side thereof is restricted. For example, a composite cable can be obtained which is particularly suitable for the underbody part (chassis) of a vehicle such as an electric parking brake, an electric brake, and the like that are limited in grounding on the wheel side as later described. In addition, according to the above-mentioned configuration, because not the power lines the outer diameters of which may be formed larger than those of the signal lines but the twisted pair line is covered with the shield conductor, the outline is easily made perfectly circular when the wires are covered with the separator. Thus, the outer diameter can be easily made small when the after-mentioned inclusion is formed on the outer circumference of the separator. For this reason, according to the above-mentioned configuration, it becomes easy to obtain a composite cable the diameter of which is circular and is easily reduced. It is noted that differently from this configuration, i.e., in the case where the power lines are covered with the shield conductor, the outer diameter when the wires are covered with the separator is likely to be elliptically shaped. Therefore, it becomes necessary to surely provide the minimum thickness in the major axis direction of the ellipse to the inclusion that covers the outer circumference part of the separator. Thus, in this case, when the cable is formed circular by the inclusion, the percentage of the inclusion is made large, so that the outer diameter including the inclusion is larger. Thus, this case is not preferred from the viewpoint of reducing the diameter of the composite cable.

As the shield conductor, a braided wire, a metal element wire, a metallic foil body, and the like may be specifically exemplified. The shield conductor may be composed of the metal element wire that covers the outer circumference of the twisted pair line by spirally winding therearound. This configuration makes it possible to obtain a composite cable that is excellent in durability of the shield conductor against repeated bending by shaking movement of the cable in comparison with the case of using the braided wire.

In the composite cable, the plurality of power lines may be configured to include at least two power lines. In this configuration, it is made possible, when viewed in the cable cross section, to dispose the signal lines on one side from a connecting line between the central axes of the power lines and to dispose the ground wire on the other side from the connecting line by arranging the two power lines in contact with each other. Therefore, according to this configuration, the at least two power lines can serve as a partition, so that the ground wire and the plurality of signal lines can be arranged isolatedly from each other with no contact. There is an advantage that the above-mentioned operational effects can be easily exhibited. More specifically, the ground wire can be disposed in a space enclosed by part of the surfaces of the plurality of power lines and part of the inner circumference of the separator. In this case, the above-mentioned operational effects can be achieved more surely.

In the composite cable, each of the signal lines, the power lines, and the ground wire may be specifically configured to include a conductor and an insulator that covers the outer circumference of the conductor. Further, in the composite cable, each outer diameter of the power lines and the ground wire can be specifically configured to meet the relation of, for example, the outer diameter of the ground wire<the outer diameter of the power line. According to this configuration, a composite cable in which the ground wire is easily blocked by the power lines and is hardly displaced to the twisted pair line side can be obtained.

In the composite cable, the separator may be composed of, for example, a material such as papers, polymers or the like.

The composite cable may be configured to further include an inclusion that is interposed between the separator and a sheath. According to this configuration, the cross section of the composite cable can be easily formed in a circular shape, and the depth of a blade cutting into the sheath can be easily set uniform at the time of peeling-off the cable end portion and/or the cable intermediate portion. Therefore, this configuration makes it possible to achieve a composite cable in which peeling-off workability for the sheath can be improved.

As a material constituting the inclusion, polyolefin-based resins such as polyethylene, polypropylene, ethylene-vinyl acetate copolymer (EVA), ethylene-ethyl acrylate copolymer (EEA), ethylene-methyl acrylate copolymer (EMA), etc., vinyl chloride resins such as polyvinyl chloride, fluorine resins, silicone resins, polyurethane resins and the like may be exemplified. One, or two or more kinds of these resins may be used singly, or in combination, and may be crosslinked as needed. Further, the inclusion may include one or two or more kinds of additives such as a flame retardant, a filer, an antioxidant, and the like.

In the case where the composite cable includes the inclusion, the separator may be configured to include a base layer composed of a polymer and an adhesive layer formed on the surface of the base layer on the inclusion side. And, the composite cable may be configured such that the adhesive layer is adhered to the inclusion.

According to this configuration, when the sheath of the composite cable is peeled off, the separator sticks to the sheath and inclusion which have been peeled off, and is taken off together therewith. Therefore, according to this configuration, it is easy to remove the separator together with the sheath and the inclusion, and to restrain falling-off of the dust of the separator at the time of peeling off the sheath in comparison with a composite cable using the separator made of thin paper. In addition, in the composite cable using a separator made of thin paper, the thin paper may stick to the ground wire in some cases. This is considered because part of the material constituting the sheath or part of the material constituting the inclusion permeates the thin paper when manufacturing the cable. By contrast, according to the above-mentioned configuration, the separator and the ground wire hardly stick to each other even when the ground wire is disposed so as to be in contact with the surface of the base layer of the separator on the wire side. Thus, according to the above-mentioned configuration, the ground wire with relatively low strength does not stick to the separator and is not pulled at the time of peeling off the sheath, and thereby a composite cable in which the joined ground wire is hardly broken can be obtained.

In the separator, as the polymer that constitutes the base layer, specifically, various types of resins can be used. As the polymer, more specifically, polyester resins such as polyethylene terephthalate, etc., vinyl chloride resins such as polyvinyl chloride, etc., polyurethane resins, and the like can be exemplified. As the polymer, polyester resins such as polyethylene terephthalate are preferably used from the viewpoints of being excellent in formability of the adhesive layer, being less likely to leave offcuts of the separator with largely different sizes, heat resistance, easy availability, and so on. Here, the polymer may contain one or two or more kinds of additives such as a flame retardant, a filler, an antioxidant, and the like. The thickness of the base layer may be specifically set preferably to 10 μm or more, more preferably to 15 μm or more, and still more preferably to 20 μm or more from the viewpoints of ensuring the strength of the separator, hardly leaving offcuts of the separator, and so on. The thickness of the base layer may be specifically set preferably to 200 μm or less, more preferably to 150 μm or less, still more preferably to 100 μm or less, and still more preferably to 50 μm or less from the viewpoints of easily increasing circularity of the cable, restraining a periodical evenness on the surface of the cable, and so on.

In the separator, the adhesive layer has adhesiveness to the inclusion and the base layer. It is noted that adhesion of the adhesive layer includes tacky adhesion. As a material constituting the adhesive layer, resins based on acrylic resins or elastomers, resins based on vinyl chloride-vinyl acetate copolymers, etc. may be specifically exemplified. One, or two or more kinds of resins may be used singly or in combination. As the resins based on acrylic resins or elastomers, ethylene-vinyl acetate copolymer (EVA), ethylene-ethyl acrylate copolymer (EEA), SEBS, SBR, etc. may be exemplified. As a material constituting the adhesive layer, a resin based on ethylene-vinyl acetate copolymer (EVA), vinyl chloride-vinyl acetate copolymer, etc. may be preferably used from the viewpoint that the separator is easily removed together with the sheath and the inclusion and falling-off of the separator dust is easily restrained. It is noted that the adhesive layer can be formed by surface modification of the surface of the base layer. The thickness of the adhesive layer may be specifically set preferably to 1 μm or more, more preferably to 1.5 μm or more, and still more preferably to 2 μm or more from the viewpoints of ensuring the adhesiveness, restraining the adhesion peeling from the inclusion, and so on. The thickness of the adhesive layer may be set preferably to 30 μm or less, more preferably to 10 μm or less, and still more preferably to 5 μm or less from the viewpoints of easily restraining adhesion between the adhesive layer sticking out from the base layer and the ground wire, and so on.

It is noted that for the purposes of adjusting the shape of the cable, and so on, the composite cable may have an inclusion inside the separator, disposed in a gap (space) that may be formed inside the separator. As the inclusion inside the separator, threads (cotton threads, etc.), cords (resin cords such as polypropylene cords, corded paper, etc.), rod-like members (resin rods such as polyethylene terephthalate resin rods, etc.) may be exemplified. These may be used in one kind, or two or more kinds in combination.

The composite cable may be used, for example, in a vehicle such as an automobile, and more specifically, may be preferably used for the underbody (chassis) of the vehicle such as an electric parking brake or an electric brake. According to this configuration, a composite cable for the underbody (chassis) of a vehicle such as an electric parking brake or an electric brake, in which noise generated by the ground wire is less likely to intrude the signal lines, can be obtained even in the case where the ground wire is combined. In the composite cable, the power lines may be used, for example, to supply an electric power required for driving the motor and to supply an electric power required for various in-vehicle devices. In addition, the signal lines may be used for various in-vehicle network communications such as transmission of an electric signal concerning control of the motor, transmission of an electric signal concerning the rotation velocity of a vehicle wheel, transmission of an electric signal of a sensor for detecting/collecting the conditions of the vehicle by a sensor mounted on the vehicle wheel and the vicinity of the vehicle wheel, vehicle control signal communication, and so on.

It is noted that the above-mentioned configurations may be arbitrarily combined with each other as needed for the purposes of obtaining the operational effects as mentioned above, and so on.

EMBODIMENTS

Hereinafter, embodiments of the composite cable will be described with reference to the drawings. It is noted that the same components will be illustrated with the same reference numbers.

Embodiment 1

A composite cable of Embodiment 1 will be described with reference to FIG. 1. As shown in FIG. 1, a composite cable 1 of the present embodiment includes a plurality of wires 2, a separator 3 that covers the outer circumference of the plurality of wires 2 all together, and a sheath 4 that covers the outer circumference of the separator 3. The plurality of wires 2 includes a plurality of signal lines 21, a plurality of power lines 22, and a ground wire 23. The ground wire 23 is isolated from the plurality of signal lines 21 with the plurality of power lines 22 interposed therebetween. The details will be described below.

In the present embodiment, the plurality of wires 2 is composed of the plurality of signal lines 21, the plurality of power lines 22, and the ground wire 23 which are twisted together as a unit. FIG. 1 specifically shows an example in which the plurality of wires 2 is made up of two signal lines 21, two power lines 22 and one ground wire 23. The two signal lines 21 are configured as a twisted pair line by twisting together with each other. The outer circumference of the twisted pair line is covered with a shield conductor 6. It is noted that, in FIG. 1, the dotted line surrounding the two signal lines 21 indicates the outer diameter of the twisted pair line. In the present embodiment, the ground wire 23 is isolated from the twisted pair line composed of the two signal lines 21 with the two power lines 22 interposed therebetween. Therefore, the ground wire 23 is not in contact with the two signal lines 21. And, the ground wire 23 is arranged so as to be in contact with the separator 3. Here, a gap 7 is formed between the plurality of wires 2 and the separator 3.

In the present embodiment, each signal line 21 includes conductors 211 and an insulator 212 that covers the outer circumference of the conductors 211. Each conductor 211 is composed of a stranded wire conductor formed by twisting a plurality of child stranded wires formed of a plurality of metal element wires twisted together. The metal element wires may be formed of, for example, copper or a copper alloy, or aluminum or an aluminum alloy. The insulator 212 is formed of, for example, cross-linked polyethylene (PE) or the like.

In the present embodiment, the shield conductor 6 is composed of a metal element wire that covers the outer circumference of the twisted pair line by spirally winding therearound. The metal element wire may be formed of, for example, copper or a copper alloy, or aluminum or an aluminum alloy.

In the present embodiment, each power line 22 includes conductors 221 and an insulator 222 that covers the outer circumference of the conductor 221. Each conductor 221 is composed of a stranded wire conductor formed by twisting a plurality of child stranded wires formed of a plurality of metal element wires twisted together. The metal element wires may be formed of, for example, copper or a copper alloy, or aluminum or an aluminum alloy. The insulator 222 may be formed of, for example, cross-linked polyethylene (PE) or the like.

In the present embodiment, the ground wire 23 includes a conductor 231 and an insulator 232 that covers the outer circumference of the conductor 231. The conductor 231 is composed of a stranded wire conductor formed by twisting a plurality of metal element wires. The metal element wires may be formed of, for example, copper or a copper alloy, or aluminum or an aluminum alloy. The insulator 232 is formed of, for example, cross-linked polyethylene (PE) or the like.

In the present embodiment, the composite cable 1 further includes an inclusion 5 that is interposed between the separator 3 and the sheath 4. The inclusion 5 may be formed of, for example, cross-linked polyethylene (PE) or the like.

In the present embodiment, the separator 3 includes a base layer 31 composed of a polymer and an adhesive layer 32 formed on the surface of the base layer 31 on the inclusion 5 side. The adhesive layer 32 of the separator 3 is adhered to the inclusion 5.

In the present embodiment, the base layer 31 of the separator 3 may be formed of, for example, a polyethylene terephthalate (PET) or the like. The adhesive layer 32 of the separator 3 may be formed of, for example, an ethylene-vinyl acetate copolymer (EVA) or the like.

In the present embodiment, the sheath 4 may be formed of, for example, a polyurethane resin (PU) or the like.

Next, operational effects of the composite cable according to the present embodiment will be described.

The composite cable 1 of the present embodiment has the above-mentioned configurations. And, in the composite cable 1 according to the present embodiment, the ground wire 23 is isolated from the plurality of signal lines 21 with the plurality of power lines 22 interposed therebetween. Accordingly, in the composite cable 1 of the present embodiment, a physical distance between the ground wire 23 and the signal lines 21 can be ensured by interposing the plurality of power lines 22 therebetween, so that electric noise generated from the ground wire 23 becomes less likely to intrude the signal lines 21 in comparison with the case where the ground wire 23 and the signal lines 21 are on the same side.

Embodiment 2

A composite cable of Embodiment 2 will be described with reference to FIG. 2. In the composite cable 1 of the present embodiment, the separator 3 is composed of papers. The other configurations are the same as those in Embodiment 1.

The same operational effects as those in Embodiment 1 can be obtained by the composite cable 1 of the present embodiment.

Embodiment 3

A composite cable of Embodiment 3 will be described with reference to FIG. 3. In the composite cable 1 of the present embodiment, the shield conductor 6 is not provided on the outer circumference of the twisted pair line that is composed of the two signal lines 21. The other configurations are the same as those in Embodiment 1.

The same operational effects as those in Embodiment 1 can be obtained by the composite cable 1 of the present embodiment. However, Embodiment 1 is more advantageous than Embodiment 3 in that electric noise generated from the ground wire 23 and the power lines 22 is less likely to intrude the signal lines 21 because the outer 25 circumference of the twisted pair line is covered with the shield conductor 6 in Embodiment 1.

Embodiment 4

A composite cable of Embodiment 4 will be described with reference to FIG. 4. In the composite cable 1 of the present embodiment, the separator 3 is composed of papers similarly to Embodiment 2. In the composite cable 1 of the present embodiment, the shield conductor 6 is not provided on the outer circumference of the twisted pair line that is composed of the two signal lines 21, similarly to Embodiment 3. The other configurations are the same as those in Embodiment 1.

The same operational effects as those in Embodiment 1 can be obtained by the composite cable 1 of the present embodiment. However, Embodiment 1 is more advantageous than Embodiment 4 in that electric noise generated from the ground wire 23 and the power lines 22 is less likely to intrude the signal lines 21 because the outer circumference of the twisted pair line is covered with the shield conductor 6 in Embodiment 1.

Embodiment 5

Figure 5:
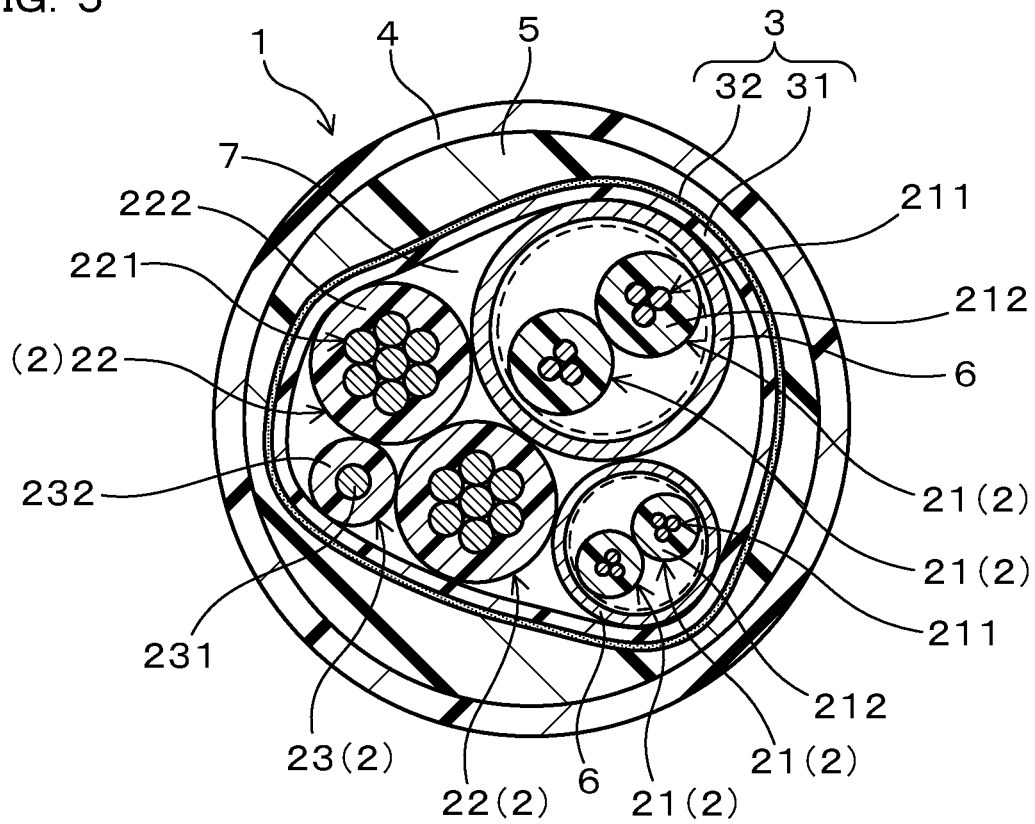
FIG. 5 is an illustration schematically showing a composite cable according to Embodiment 5 in a cross section perpendicular to the center axis of the cable.

A composite cable of Embodiment 5 will be described with reference to FIG. 5. In the composite cable 1 of the present embodiment, the plurality of wires 2 includes two twisted pair lines each composed of the two signal lines 21 twisted together. FIG. 5 specifically shows an example in which the plurality of wires 2 includes four signal lines 21, two power lines 22, and one ground wire 23. Two signal lines 21 of the four signal lines 21 are twisted together to form a twisted par line, and the other two signal lines 21 are also twisted together to form another twisted pair line. Each twisted pair line has the outer circumference covered with the shield conductor 6. Here, the ground wire 23 is isolated from each twisted pair line with the power lines 22 interposed therebetween.

In the present embodiment, the shield conductor 6 is composed of a braided wire. The braided wire is formed of a plurality of metal element wires braided together. The metal element wires may be formed of, for example, copper or a copper alloy, or aluminum or an aluminum alloy. The other configurations are the same as those in Embodiment 1.

The same operational effects as those in Embodiment 1 can be obtained by the composite cable 1 of the present embodiment.

EXPERIMENTAL EXAMPLES

Hereinafter, the composite cable will be more specifically described with reference to experimental examples.

Experimental Example 1

Composite cables configured as shown in Table 1 were prepared.

—Sample 1, Sample 2—

One twisted pair line having the outer circumference covered with a shield conductor, two power lines, and one ground wire were twisted together so as to form a core wire structure as shown in FIG. 1. And then, the outer circumference of the core wire was covered by a separator. Here, the separator was provided such that the adhesive layer was set to be an outer circumference. Then, by extrusion molding, the outer circumference of the separator was covered by an inclusion extruded thereon circularly. Then, by extrusion molding, the outer circumference of the inclusion was covered by a sheath extruded thereon. Thus, the composite cables of Sample 1 and Sample 2 were obtained.

—Sample 3, Sample 4—

Figure 2:
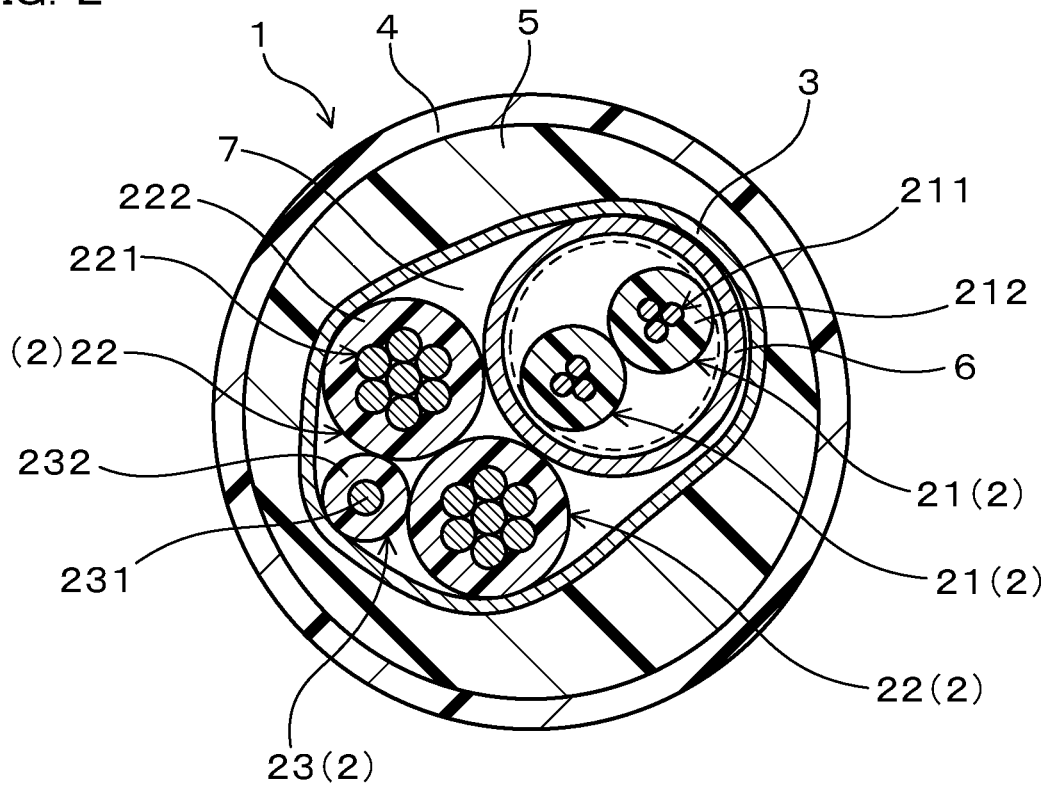
FIG. 2 is an illustration schematically showing a composite cable according to Embodiment 2 in a cross section perpendicular to the center axis of the cable.

One twisted pair line having the outer circumference covered with a shield conductor, two power lines, and one ground wire were twisted together so as to form a core wire structure as shown in FIG. 2. And then, the outer circumference of the core wire was covered by a separator. Then, by extrusion molding, the outer circumference of the separator was covered by an inclusion extruded thereon circularly. Then, by extrusion molding, the outer circumference of the inclusion was covered by a sheath extruded thereon. Thus, the composite cables of Sample 3 and Sample 4 were obtained.

—Sample 5—

Figure 3:
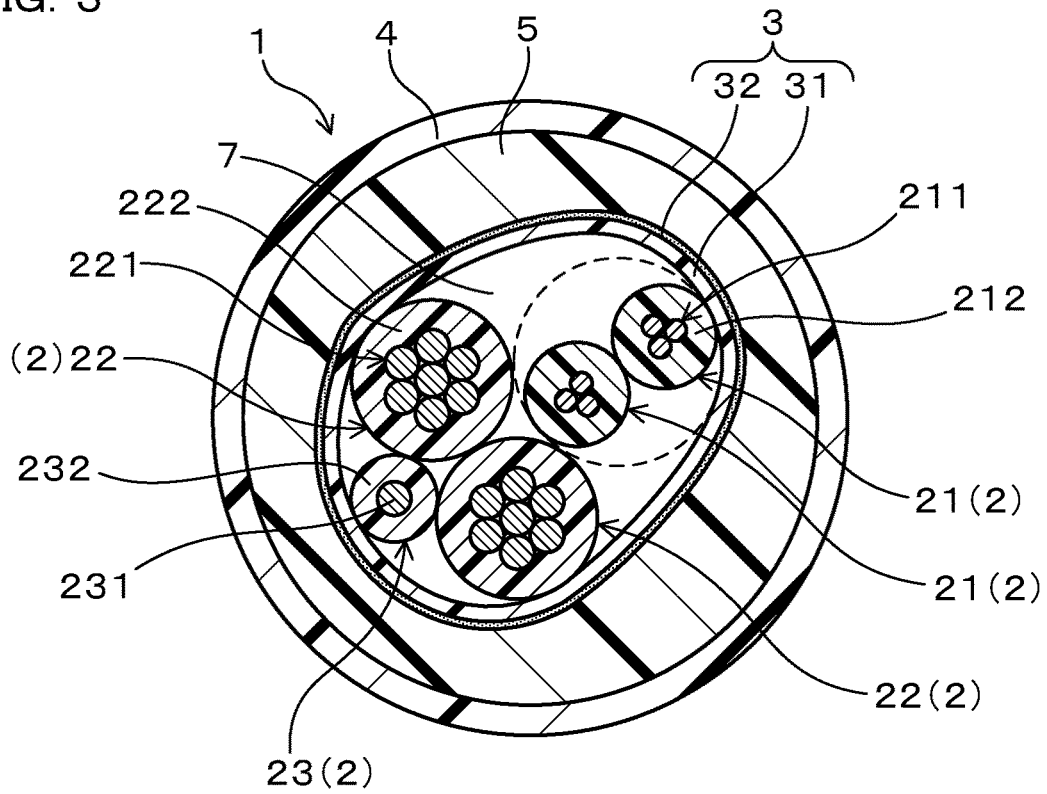
FIG. 3 is an illustration schematically showing a composite cable according to Embodiment 3 in a cross section perpendicular to the center axis of the cable.

One twisted pair line having the outer circumference not covered with a shield conductor, two power lines, and one ground wire were twisted together so as to form a core wire structure as shown in FIG. 3. And then, the outer circumference of the core wire was covered by a separator. Here, the separator was provided such that the adhesive layer was set to be an outer circumference. Then, by extrusion molding, the outer circumference of the separator was covered by an inclusion extruded thereon circularly. Then, by extrusion molding, the outer circumference of the inclusion was covered by a sheath extruded thereon. Thus, the composite cable of Sample 5 was obtained.

—Sample 6—

Figure 4:
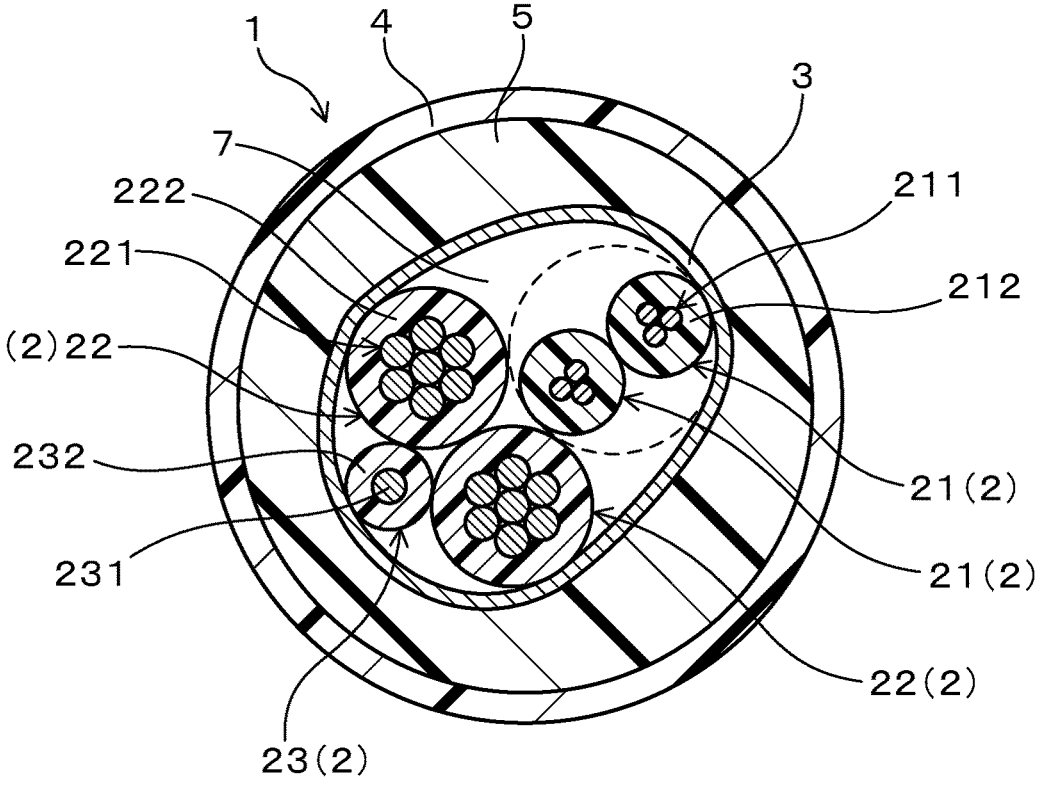
FIG. 4 is an illustration schematically showing a composite cable according to Embodiment 4 in a cross section perpendicular to the center axis of the cable.

One twisted pair line having the outer circumference not covered with a shield conductor, two power lines, and one ground wire were twisted together so as to form a core wire structure as shown in FIG. 4. And then, the outer circumference of the core wire was covered by a separator. Then, by extrusion molding, the outer circumference of the separator was covered by an inclusion extruded thereon circularly. Then, by extrusion molding, the outer circumference of the inclusion was covered by a sheath extruded thereon. Thus, the composite cable of Sample 6 was obtained. It is noted that the separators of Samples 3, 4 and 6 are made of pulp paper.

TABLE 1

| Cross-sectional Structure of Cable | | | | Sample 1 FIG. 1 | Sample 2 FIG. 1 | Sample 3 FIG. 2 | Sample 4 FIG. 2 | Sample 5 FIG. 3 | Sample 6 FIG. 4 |
|---|---|---|---|---|---|---|---|---|---|
| Power Line | Conductor | Configuration | Number/Number/mm | 7/72/0.08 | 7/72/0.08 | 7/72/0.08 | 7/72/0.08 | 7/72/0.08 | 7/72/0.08 |
| | | Type of Element Wire | — | Copper Alloy Wire | Copper Alloy Wire | Copper Alloy Wire | Copper Alloy Wire | Copper Alloy Wire | Copper Alloy Wire |
| | | Size | $mm^2$ | 2.5 | 2.5 | 2.5 | 2.5 | 2.5 | 2.5 |
| | | Outer Diameter | mm | Approximately 2.4 | Approximately 2.4 | Approximately 2.4 | Approximately 2.4 | Approximately 2.4 | Approximately 2.4 |
| | Insulator | Material | — | Flame-retardant Crosslinked PE | Flame-retardant Crosslinked PE | Flame-retardant Crosslinked PE | Flame-retardant Crosslinked PE | Flame-retardant Crosslinked PE | Flame-retardant Crosslinked PE |
| | | Outer Diameter | mm | 3.2 | 3.2 | 3.2 | 3.2 | 3.2 | 3.2 |
| Signal Line | Conductor | Configuration | Number/Number/mm | 3/16/0.08 | 3/16/0.08 | 3/16/0.08 | 3/16/0.08 | 3/16/0.08 | 3/16/0.08 |
| | | Type of Element Wire | — | Copper Alloy Wire | Copper Alloy Wire | Copper Alloy Wire | Copper Alloy Wire | Copper Alloy Wire | Copper Alloy Wire |
| | | Size | $mm^2$ | 0.25 | 0.25 | 0.25 | 0.25 | 0.25 | 0.25 |
| | | Outer Diameter | mm | Approximately 0.8 | Approximately 0.8 | Approximately 0.8 | Approximately 0.8 | Approximately 0.8 | Approximately 0.8 |
| | Insulator | Material | — | Flame-retardant Crosslinked PE | Flame-retardant Crosslinked PE | Flame-retardant Crosslinked PE | Flame-retardant Crosslinked PE | Flame-retardant Crosslinked PE | Flame-retardant Crosslinked PE |
| | | Outer Diameter | mm | 2.2 | 2.2 | 2.2 | 2.2 | 2.2 | 2.2 |
| | Stranding | Core Number | Core | 2 | 2 | 2 | 2 | 2 | 2 |
| | | Outer Diameter | mm | 4.4 | 4.4 | 4.4 | 4.4 | 4.4 | 4.4 |
| | Shield Conductor | Form | — | Spirally-wound Copper Alloy | Braided Copper Alloy | Spirally-wound Copper Alloy | Braided Copper Alloy | — | — |
| | | Outer Diameter | mm | Approximately 4.6 | Approximately 4.9 | Approximately 4.6 | Approximately 4.9 | | |
| Ground Wire | Conductor | Configuration | Number/mm | 60/0.08 | 60/0.08 | 60/0.08 | 60/0.08 | 60/0.08 | 60/0.08 |
| | | Type of Element Wire | — | Copper Alloy Wire | Copper Alloy Wire | Copper Alloy Wire | Copper Alloy Wire | Copper Alloy Wire | Copper Alloy Wire |
| | | Size | $mm^2$ | 0.3 | 0.3 | 0.3 | 0.3 | 0.3 | 0.3 |
| | | Outer Diameter | mm | Approximately 0.7 | Approximately 0.7 | Approximately 0.7 | Approximately 0.7 | Approximately 0.7 | Approximately 0.7 |
| | Insulator | Material | — | Flame-retardant Crosslinked PE | Flame-retardant Crosslinked PE | Flame-retardant Crosslinked PE | Flame-retardant Crosslinked PE | Flame-retardant Crosslinked PE | Flame-retardant Crosslinked PE |
| | | Outer Diameter | mm | 1.45 | 1.45 | 1.45 | 1.45 | 1.45 | 1.45 |
| Separator | Base Layer | Material | — | PET | PET | PET | PET | PET | — |
| | | Thickness | μm | 10 | 20 | 25 | 50 | 100 | |
| | Adhesive Layer | Material | — | EVA | EVA | EVA | EVA | EVA | |
| | | Thickness | μm | 1 | 3 | 3 | 10 | 30 | |
| | Papers | Thickness | μm | — | — | — | — | — | 30 |

TABLE 1-continued

| Cross-sectional Structure of Cable | | | Sample 1 FIG. 1 | Sample 2 FIG. 1 | Sample 3 FIG. 2 | Sample 4 FIG. 2 | Sample 5 FIG. 3 | Sample 6 FIG. 4 |
|---|---|---|---|---|---|---|---|---|
| Inclusion | Material | — | Crosslinked PE | Crosslinked PE | Crosslinked PE | Crosslinked PE | Crosslinked PE | Crosslinked PE |
| | Outer Diameter | mm | 10.3 | 10.7 | 10.4 | 10.7 | 10.4 | 10.2 |
| Sheath | Material | — | Flame-retardant Crosslinked PU | Flame-retardant Crosslinked PU | Flame-retardant Crosslinked PU | Flame-retardant Crosslinked PU | Flame-retardant Crosslinked PU | Flame-retardant Crosslinked PU |
| | Outer Diameter | mm | 11.5 | 11.9 | 11.6 | 11.9 | 11.6 | 11.4 |

(Note 1)
"Number/Number/mm" means "Number of child stranded wires in a stranded wire/Number of element wires in a child stranded wire/Diameter of an element wire (mm)".
"Number/mm" means "Number of element wires in a stranded wire/Diameter of an element wire (mm)".

In the composite cables of the samples thus prepared, the ground wire is isolated from the two signal lines with the two power lines interposed therebetween. Accordingly, in the composite cables of the samples, a physical distance between the ground wire and the signal lines can be ensured by interposing the two power lines therebetween, so that electric noise generated from the ground wire becomes less likely to intrude the signal lines in comparison with the case where the ground wire and the signal lines are on the same side.

Experimental Example 2

As a representative for the composite cables of Samples 1, 2, and 5, the composite cable of Sample 1 was adopted. And, 30 composite cables of Sample 1 were prepared. Meanwhile, as a representative for the composite cables of Samples 3, 4, and 6, the composite cable of Sample 3 was adopted. And, 30 composite cables of Sample 3 were prepared.

For each sample cable, a cable cut-off test and a sheath peel-off test were conducted using a fully automatic wire cutting and peeling machine ("Casting C377A" manufactured by KODERA Electronic Co., Ltd.). The standard value of cable cutting length was set to 1000 mm, and sheath peeling-off length was set to 35 mm and 40 mm as two conditions. The results are shown in Table 2.

TABLE 2

| | | Cable Cutting Length (mm) | Sheath Peeling-off Length (mm) | Sheath Peeling-off Length (mm) |
|---|---|---|---|---|
| Condition | | 1000 | 35 | 40 |
| Upper Limit | | 1002 | 37 | 42 |
| Lower Limit | | 998 | 33 | 38 |
| Test No. | 1 | 1000 | 35 | 40 |
| | 2 | 999 | 36 | 41 |
| | 3 | 1001 | 36 | 40 |
| | 4 | 1000 | 36 | 40 |
| | 5 | 1000 | 36 | 40 |
| | 6 | 1000 | 36 | 40 |
| | 7 | 1000 | 36 | 41 |
| | 8 | 1000 | 36 | 40 |
| | 9 | 1001 | 36 | 40 |
| | 10 | 1001 | 35 | 40 |
| | 11 | 1001 | 36 | 40 |
| | 12 | 1001 | 36 | 40 |
| | 13 | 1000 | 36 | 40 |
| | 14 | 1001 | 36 | 40 |
| | 15 | 1001 | 36 | 40 |
| | 16 | 1000 | 35 | 40 |
| | 17 | 1000 | 36 | 40 |
| | 18 | 1000 | 36 | 40 |
| | 19 | 1000 | 35 | 41 |
| | 20 | 1000 | 36 | 40 |
| | 21 | 999 | 35 | 40 |
| | 22 | 1001 | 36 | 40 |
| | 23 | 1000 | 36 | 41 |
| | 24 | 1000 | 36 | 40 |
| | 25 | 1000 | 36 | 40 |
| | 26 | 1000 | 36 | 40 |
| | 27 | 1001 | 36 | 41 |
| | 28 | 1000 | 36 | 41 |
| | 29 | 1001 | 35 | 40 |
| | 30 | 1000 | 35 | 40 |
| Average Value | | 1000 | 35.8 | 40.2 |
| Maximum Value | | 1001 | 36 | 41 |
| Minimum Value | | 999 | 35 | 40 |

As shown in Table 2, it was confirmed that the cable cutting length and the sheath peeling-off length were not adversely affected by the configuration in which the separator is constituted of the base layer and the adhesive layer.

Next, a generation degree of the separator dust and a generation degree of cut-off piece residue of the separator in the above-mentioned tests were confirmed.

As the result, the number of the composite cables of Sample 3 in which separator dust (paper dust in the present example) was generated was 30 out of a total of 30. By contrast, the number of the composite cables of Sample 1 in which separator dust was generated was 0 out of a total of 30. From this result, it was confirmed that falling-off of the separator dust that would generate at the time of peeling off the sheath can be more easily restrained by constituting the separator by the base layer composed of a polymer and the adhesive layer formed on the surface of the base layer on the inclusion side, as compared with conventional techniques. This is because when the sheath was peeled off, the separator stuck to the sheath and inclusion which had been peeled off, and was taken off together therewith, so that the separator could be removed together with the sheath and the inclusion.

Meanwhile, the number of the composite cables of Sample 3 in which residue of the cut-off separator pieces was generated was 16 out of a total of 30. By contrast, the number of the composite cables of Sample 1 in which residue of the cut-off separator pieces was generated was 14 out of a total of 30. Moreover, as for the shape of the cut-off separator piece(s), uneven cut-off pieces of various sizes could be confirmed in the composite cables of Sample 3. By contrast, in the composite cables of Sample 1, the cut-off pieces of the separator have the size of 2 to 3 mm at most, which was in the allowable range in a mass-production process. Furthermore, in the composite cables of Sample 1, it was confirmed that the cut-off pieces of the separator could be removed at the time of removing the sheath. From these results, it was confirmed that the separator constituted by the base layer and the adhesive layer could easily avoid leaving various size of cut-off pieces as compared with the separator composed of papers.

Also in the case where the thickness of the base layer was set in the range of 10 to 200 μm and the thickness of the adhesive layer was set in the range of 1 to 50 μm in the configuration of the composite cable of Sample 1, the same results were obtained. It is noted that when the thickness of the base layer was less than the above-mentioned range, the cable is likely to be broken to thereby deteriorate productivity. In addition, the end(s) of the separator was/were shredded in some cases. When the thickness of the base layer was made larger than the above-mentioned range, the winding diameter became larger owing to the reaction force of the separator, so that there was found the tendency that the circularity of the cable was reduced. Moreover, in some cases, periodical unevenness occurred on the surface of the cable. When the thickness of the adhesive layer was made thinner than the above-mentioned range, there was found the tendency that the adhesion peeling of the adhesive layer from the inclusion occurred. When the thickness of the adhesive layer was made larger than the above-mentioned range, there was found the tendency that the adhesive layer was stuck out of the base layer and was adhered to the wire to thereby deteriorate the processability. Thus, it was confirmed that the thickness of the base layer and the thickness of the adhesive layer are preferably set within the above-mentioned range for these reasons.

As mentioned above, although the embodiments of the present invention have been described in detail, the present invention is not limited to the above-mentioned embodiments and experimental examples, and various modifications can be made within the scope that does not depart from the spirit of the present invention.

The invention claimed is:

1. A composite cable comprising: a plurality of wires; a separator that covers an outer circumference of the plurality of wires all together; a sheath that covers an outer circumference of the separator; and an inclusion that is interposed between the separator and the sheath, wherein the plurality of wires includes a plurality of signal lines, a plurality of power lines, and a ground wire, the ground wire is isolated from the plurality of signal lines with the plurality of power lines interposed therebetween, and the separator has a base layer composed of a polymer and an adhesive layer formed on a surface of the base layer on the inclusion side, and the adhesive layer adheres to the inclusion.

2. The composite cable according to claim 1, wherein the plurality of signal lines includes at least one twisted pair wire composed of two signal lines twisted together, an outer circumference of the twisted pair wire being covered with a shield conductor.

3. The composite cable according to claim 1, wherein the plurality of power lines includes at least two power lines.

4. The composite cable according to claim 2, wherein the plurality of power lines includes at least two power lines.

* * * * *